US006058512A

United States Patent [19]

Miyawaki

[11] Patent Number: 6,058,512

[45] **Date of Patent: *May 9, 2000**

[54] DECORATIVE WEAR

[76] Inventor: Yoshiko Miyawaki, Wako Patent Research-Nai, 3-1-8, Bakuro-machi, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,020

[22] Filed: Apr. 29, 1997

[51] Int. Cl.[7] ..... A41D 27/08

[52] U.S. Cl. ..... 2/244; 2/122

[58] Field of Search ..... 2/105, 106, 49.1, 2/49.2, 49.3, 49.4, 49.5, 50, 51, 52, 75, 80, 83, 90, 91, 113, 114, 115, 117, 118, 119, 120, 244, 243.1, 121, 122, 102, 46–48, 69, 74, 108, 85, 93, 227, 228, 238, 67, 144, 211, 1, 279, 88, 116

[56] References Cited

U.S. PATENT DOCUMENTS

| | | | |
|---|---|---|---|
| 30,154 | 11/1860 | Perego, Jr. | 2/116 |
| 44,781 | 11/1864 | Brady | 2/116 |
| 49,703 | 9/1865 | Billon | 2/116 |
| 55,974 | 7/1866 | Arnold | 2/116 |
| 120,462 | 10/1871 | Sibley | 2/116 |
| 151,047 | 5/1874 | Osgood | 2/116 |
| D. 155,381 | 10/1949 | Black | 2/116 |
| 668,683 | 2/1901 | Johnson | 2/116 |
| 2,647,262 | 8/1953 | Crothers | 2/116 |
| 4,062,062 | 12/1977 | Basaldua | 2/105 |
| 4,097,933 | 7/1978 | de Polo | 2/105 |
| 4,176,408 | 12/1979 | de Polo | 2/69 |
| 4,616,365 | 10/1986 | Lyons | 2/69 |

FOREIGN PATENT DOCUMENTS

| | | | |
|---|---|---|---|
| 21304 | of 1907 | United Kingdom | 2/243.1 |

*Primary Examiner*—John J. Calvert
*Assistant Examiner*—Alissa L. Hoey
*Attorney, Agent, or Firm*—Jordan and Hamburg LLP

[57] ABSTRACT

Use is made of remaining stock neck ties to provide gorgeous and elegant decorative wear and also realize effective processing of remaining stock neck ties and resources saving.

The decorative wear according to the invention is formed by using decorative cloth which is prepared by sewing together a plurality of neck ties side by side.

7 Claims, 2 Drawing Sheets

DECORATIVE WEAR

BACKGROUND OF THE INVENTION

1. Field of the Invention

This invention relates to decorative wear making use of neckties.

2. Prior Art

In the neck tie manufacturing and selling companies, the problem of remaining stock has been inevitable due to the fashion and other reasons.

Usually, the remaining stock neck ties are disposed with in bargain sales or as service items, and the final remaining stock is discarded.

For the above reasons, there has recently been a strong dealer's demand for the appearance of commodities which make use of remaining stock neck ties. Up to date, however, there has been no such commodity.

SUMMARY OF THE INVENTION

The inventor has noted that any neck tie has its own decorative beauty, and the invention has an object of providing decorative wear pieces, which are formed by using decorative cloth utilizing neck ties and can meet the demand noted above and is effective for the effective utility of remaining stock neck ties and saving of resources.

To attain this object of the invention, the decorative wear according to the invention features that it uses decorative cloth obtained by sewing together a plurality of neck ties side by side.

With the decorative wear according to the invention, the constituent decorative cloth has gorgeous and element decorative beauty which is based on the gathering of the patterns of the individual neck ties and has a great effect as a new fashion of wear.

It is a further effect of the invention that neck tie manufacturing and selling companies can realize effective utilization of remaining stock neck ties and contribute to the saving of resources.

DETAILED DESCRIPTION OF THE PREFERRED EMBODIMENTS

The decorative cloth wear 1 according to the invention uses decorative cloth 10, which is prepared by using remaining stock neck ties 11 in neck tie manufacturing or selling companies. Using the decorative cloth 10, vests, cardigans, sweaters, and other wear pieces are produced.

Figure 1:
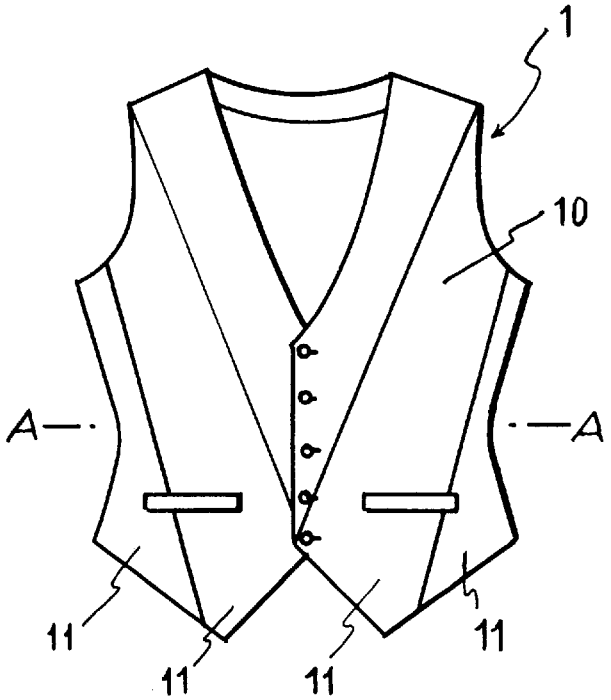
FIG. 1 is a front view showing one embodiment of the decorative wear according to the invention.

In the illustrated examples, the decorative cloth 10 is applied to vests. In the vest shown in FIG. 1, a plurality of neck ties are sewn side by side in conformity to the inclination of neck line of the wear, and the whole front part thereof is constituted by the neck ties. The back part of the wear, like the front part, is formed with neck ties sewn obliquely or vertically side by side.

Figure 2:
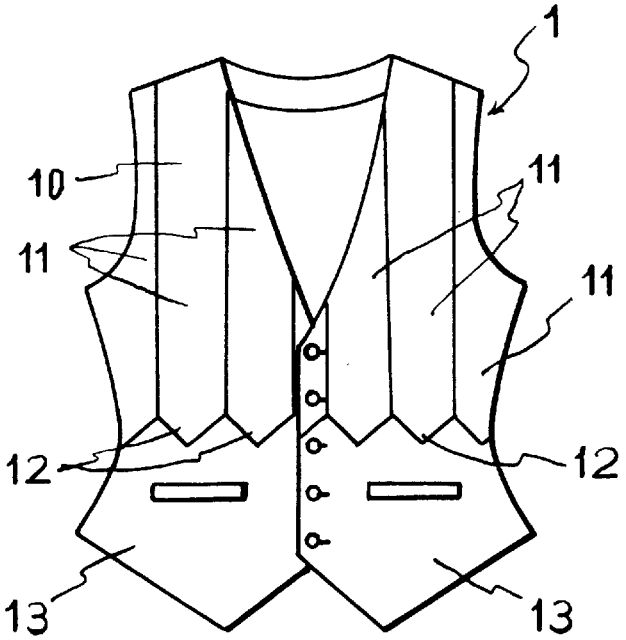
FIG. 2 is a front view showing a second example of the pattern of decorative cloth.

The example of vest shown in FIG. 2 uses a plurality of neck ties 11 sewn vertically side by side such that the V-shaped ends 12 of the neck ties are found along a horizontal line in a lower portion of the front part of the wear. For the lower portion of the front part of the wear, the usual wear cloth 13 is used.

The back part of the wear, like the front part, may be formed by using the decorative cloth 10 obtainable with neck ties and also with the usual wear cloth 13, or by using the sole decorative or usual wear cloth 10 or 13.

Figure 3:
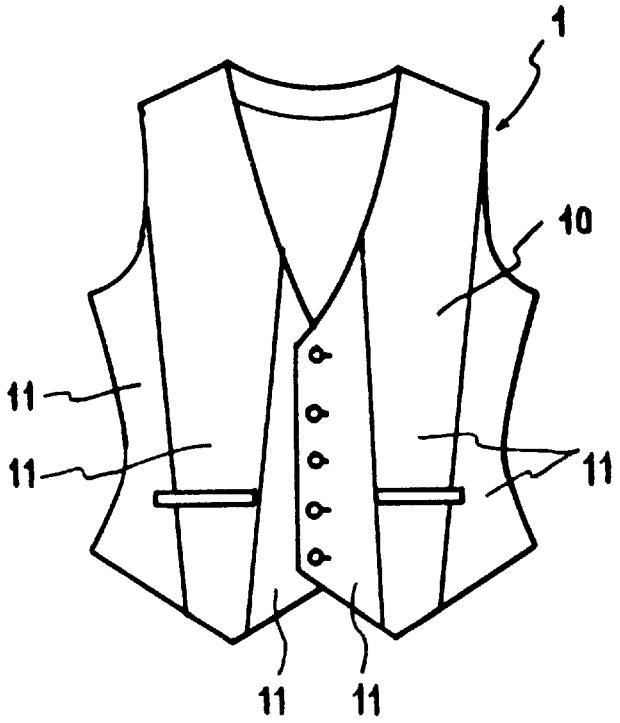
FIG. 3 is a front view showing a third example of the pattern of decorative cloth.
Figure 4:
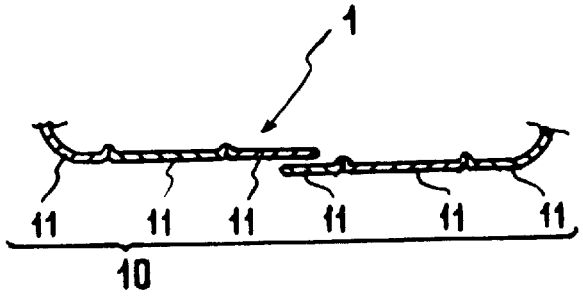
FIG. 4 is a sectional view taken along line A—A in FIG. 1.

The example of vest shown in FIG. 3 has the whole front part formed by using decorative cloth 10, which is obtained by sewing side by side vertically inverted and non-inverted neck ties in an alternate arrangement.

Again in this example, like the example of FIG. 2, usual wear cloth 13 may be used for the lower portion of the front part and also for the back part.

Figure 5:
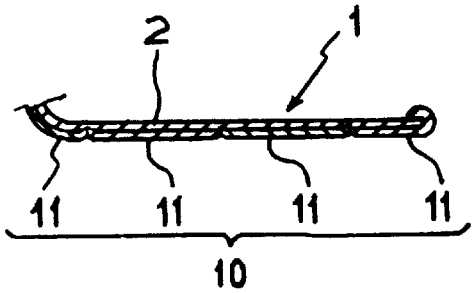
FIG. 5 is a sectional view showing a second embodiment of the invention.

FIG. 5 shows another embodiment of the invention, which uses a back cloth 3 on the inner side of the decorative cloth 10 using the neck ties.

As has been shown in the foregoing, according to the invention a decorative cloth prepared by sewing together a plurality of neck ties side by side is used to produce wear. Thus, with the decorative wear according to the invention, the constituent decorative cloth presents gorgeous and element beauty owing to the gathering of the patterns of the individual element neck ties, thus presenting a great effect as new fashion of the wear.

Further, neck tie manufacturing and selling companies can realize effective utility of remaining stock neck ties and contribute to the saving of resources. The invention is thus greatly beneficial.

What is claimed is:

1. An item of clothing comprising a plurality of neckties initially adapted to be worn about a person's neck and tied in front of the person's neck, stitching thread stitching said plurality of neckties together to form the item of clothing, and a base cloth, said stitching threads stitching said neckties to said base cloth.

2. An item of clothing according to claim 1 wherein said stitching threads stitches juxtaposed neckties to one another.

3. An item of clothing according to claim 1 wherein each of said neckties has elongated opposite non-parallel side edges.

4. An item of clothing according to claim 1 wherein each of said neckties has an elongate central axis, said neckties having opposite side edges which converge relative to said elongate central axis.

5. An item of clothing according to claim 4 wherein said stitching thread stitches one of said opposite side edges of one necktie to one of said opposite side edges of another juxtaposed necktie.

6. An item of clothing according to claim 1 wherein said opposite side edges are designated first opposite side edges, each of said neckties further including second opposite side edges which converge relative to said central axis.

7. The method of making an item of clothing comprising providing a plurality of neckties in which each necktie includes a narrow length of necktie material initially adapted to be worn about a person's neck and tied in front of the person's neck, sewing said plurality of neckties to one another to form a necktie cloth, forming said necktie cloth into a finished item of clothing, and sewing a base cloth onto said necktie cloth.

* * * * *